United States Patent [19]

Voorheis

[11] 3,966,123

[45] June 29, 1976

[54] BURNER GUN

[76] Inventor: James T. Voorheis, 53 Park Lane, Essex Fells, N.J. 07021

[22] Filed: Dec. 5, 1974

[21] Appl. No.: 529,598

[52] U.S. Cl. ..... 239/401; 239/404; 239/416; 239/417.3

[51] Int. Cl.[2] ..... B05B 7/10

[58] Field of Search ..... 239/401, 403, 404, 416, 239/416.5, 417.3, 402.5

[56] References Cited

UNITED STATES PATENTS

| | | | |
|---|---|---|---|
| 872,288 | 11/1907 | Koons | 239/402.5 |
| 1,439,320 | 12/1922 | Morse | 239/417.3 |
| 3,758,259 | 9/1973 | Voorheis | 431/182 |

FOREIGN PATENTS OR APPLICATIONS

| | | | |
|---|---|---|---|
| 515,855 | 12/1952 | Belgium | 239/403 |

*Primary Examiner*—Carroll B. Dority, Jr.
*Attorney, Agent, or Firm*—Norman N. Popper

[57] ABSTRACT

A burner gun to provide a narrow spray pattern under high or low fire conditions, having a nozzle with an elongated tunnel passage therein which nozzle is spacially adjustable with respect to a spray tip; the spray tip has an oil swirl chamber with an axially movable piston to obstruct in varying degree oil intake ports in the swirl chamber, to reduce the flow when low fire operation is required.

8 Claims, 4 Drawing Figures

BURNER GUN

RELATED APPLICATION

The present invention is related to U.S. Pat. No. 3,758,259 in that it adds an adjustable nozzle with an elongated tunnel passage, and an adjustable oil swirl chamber wherein an axially movable piston controls the oil intake by obstructing oil intake ports in varying degree.

BACKGROUND OF THE INVENTION

1. Field of the Invention

This invention relates generally to burner gun assemblies, and particularly to such assemblies wherein a narrow spray pattern is achieved at both low and high flame conditions, adjustably controlling the introduction of fuel into a swirl chamber and optimizing the spacial relationship between an adjustable nozzle and a spray tip.

2. Description of the Prior Art

In the burner gun assembly shown in my U.S. Pat. No. 3,758,259 high or low fire condition is controlled by increasing or decreasing the pressure at which oil is introduced into the gun. Under low fire conditions, the spray pattern became wider than under high fire conditions. But a narrow spray pattern is desirable for many applications. By reason of the absence of means for controlling the spray pattern under low fire conditions, the burner gun therein disclosed was unsatisfactory in some applications. To merely elongate the burner nozzle shown in the patent, did not achieve the desired result but caused some oil droplets to collect on the elongated nozzle and drip into the combustion chamber.

It has been found that if a narrow spray pattern is preferred for a particular application, a burner gun can be devised which will achieve the preferred narrow spray pattern regardless of whether the burner is being operated at high or low fire conditions.

SUMMARY OF THE INVENTION

The present burner gun assembly can be operated at either low or high flame condition and when properly adjusted invariably provides a narrow spray pattern. This is accomplished by providing a nozzle with an elongated tunnel passage therein. The nozzle is adjustable as to position with respect to the spray tip. The spray tip has an oil swirl chamber therein wherein an axially movable piston can be positioned to obstruct in varying degree oil intake ports. Since the oil introduced into the chamber is introduced therein at constant pressure, without reducing the pressure in order to accomplish low fire conditions, the oil discharge from the tip does not collect on the elongated tunnel passage and drip therefrom, but at all times maintains the preferred narrow spray pattern. The position of the nozzle with respect to the spray tip is subject to adjustment in order to provide the optimum elongated spray pattern, which is then achieved regardless of the degree of obstruction of the oil ports in the swirl chamber which the piston may accomplish by virtue of its axial movement.

THE DRAWINGS

These objects and advantages as well as other objects and advantages may be achieved by the device shown by way of illustration in the drawings in which.

PREFERRED EMBODIMENT

Figure 1:
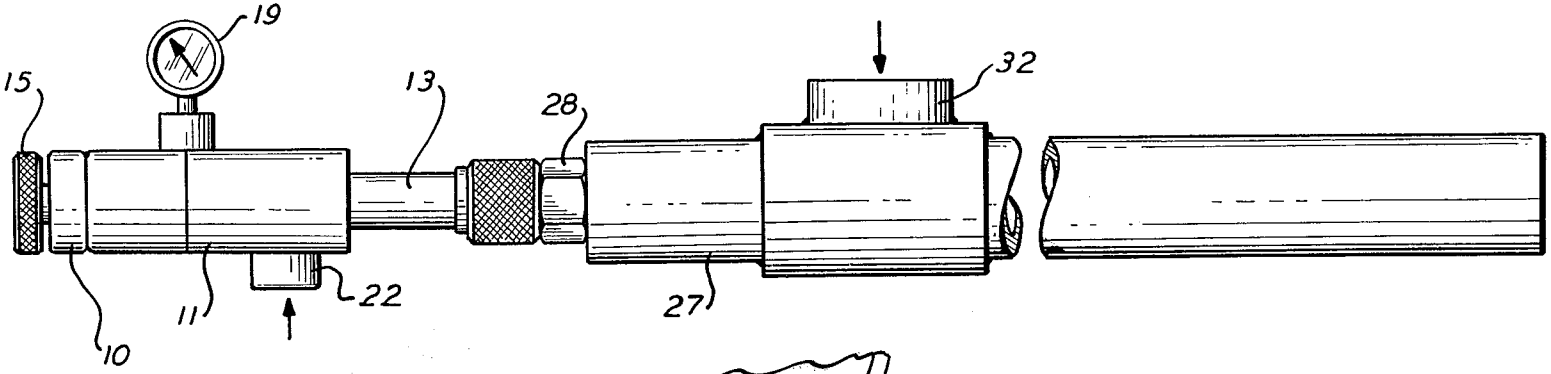
FIG. 1 is a side elevational view of the burner gun.
Figure 2:
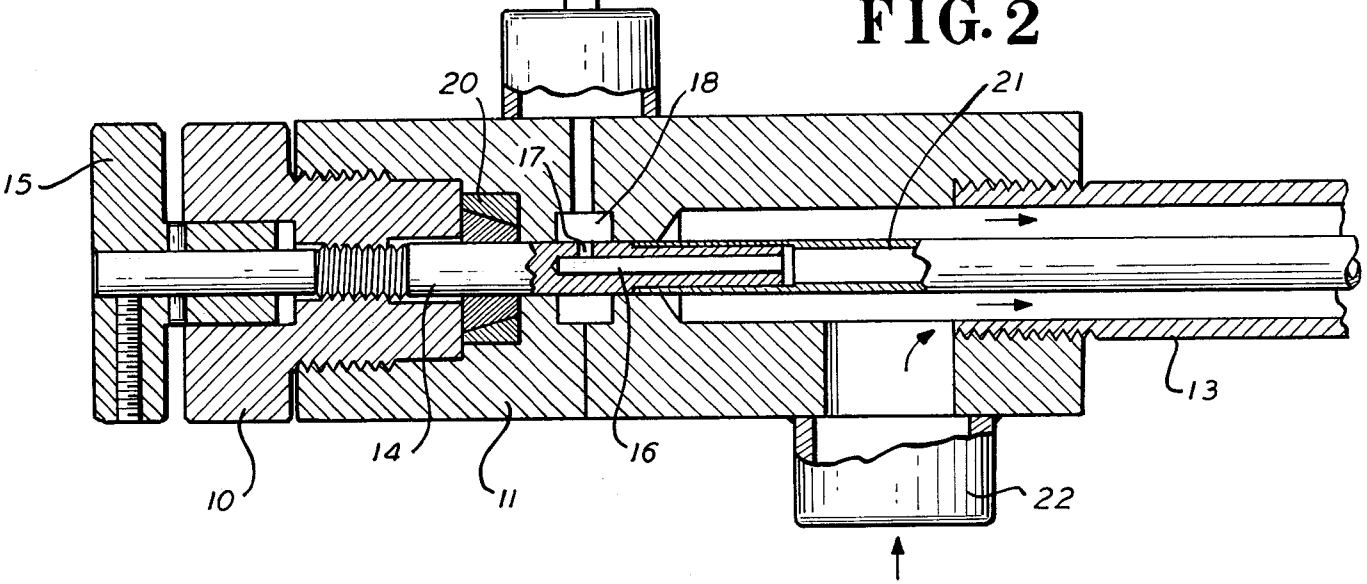
FIG. 2 is an enlarged, partial, vertical, sectional view of the left end portion of the burner shown in FIG. 1.
Figure 3:
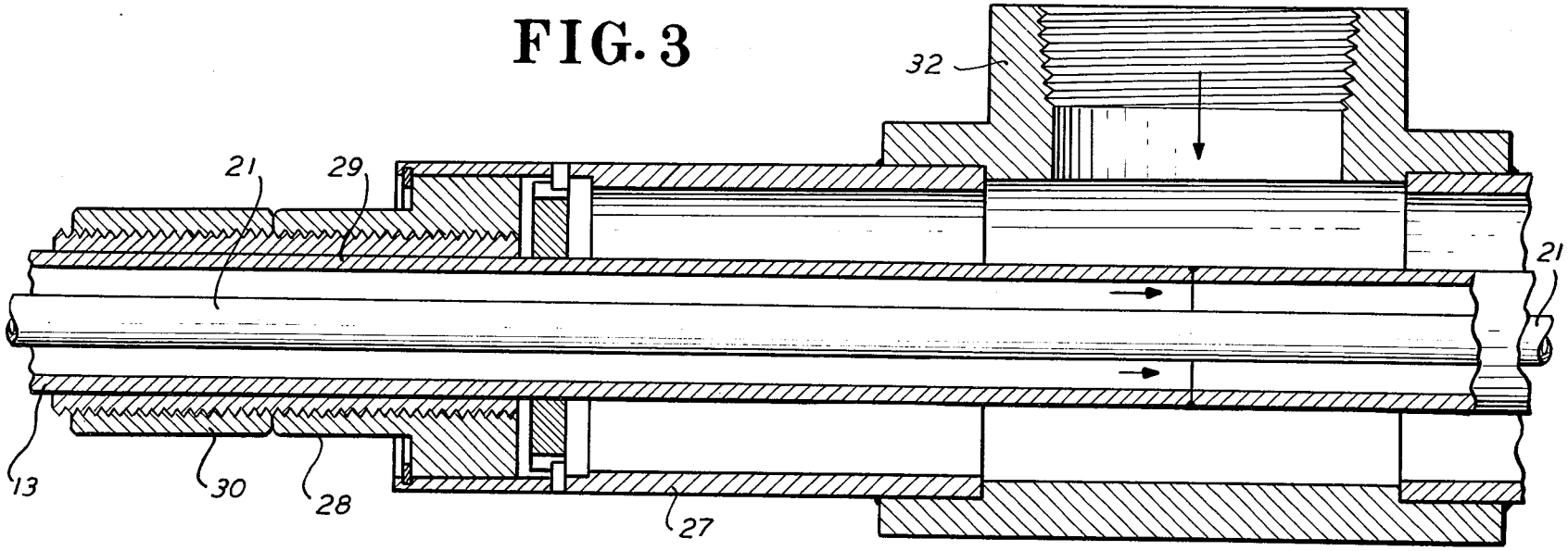
FIG. 3 is an enlarged, partial, vertical, sectional view of the middle portion of the burner shown in FIG. 1.
Figure 4:
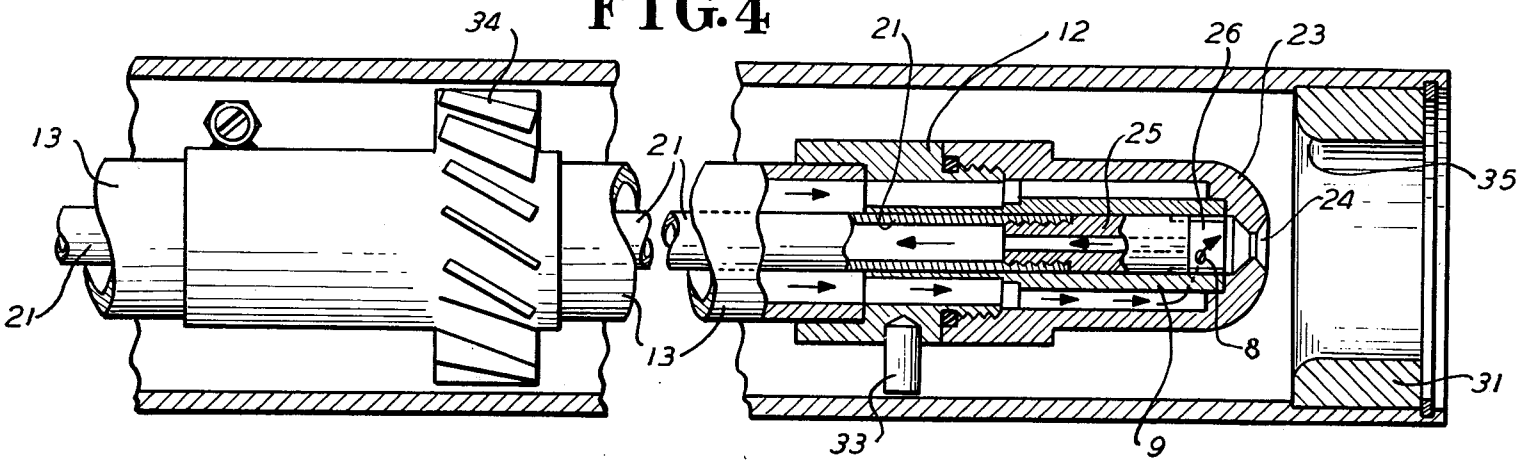
FIG. 4 is an enlarged, partial, vertical, sectional view of the right end portion of the burner shown in FIG. 1.

Referring now to the drawings in detail, there is an oil tube 13 for conducting oil to be burned. Attached to the oil tube 13 is a first housing 11 which is in threaded engagement with the oil tube 13. A gland 10 is inserted in threaded engagement with the housing 11. The regulator shaft 14 is positioned in the housing 11 in threaded engagement with the gland 10. A knob 15 is attached to the shaft 14 so that upon rotation, the regulator shaft 14 may be advanced or retracted in the housing. The shaft 14 is provided with a partial axial bore 16 at one end. The bore 16 communicates with a radial passage 17. An elongated chamber 18 in the housing 11 is long enough to be in registration with the passage 17 whether or not the regulator shaft 14 is advanced or retracted. The chamber 18 communicates with an oil pressure gauge 19, mounted on the housing 11. The glad 10 engages a compressible oil seal 20. The regulator shaft 14 is rigidly attached to a piston tube 21 which extends out of the housing 11. The piston tube 21 is surrounded by the oil tube 13. An oil inlet 22 in the first housing 11 conducts oil into the oil tube 13 where it flows through the oil tube 13 to a second housing 12.

The second housing 12 is tubular and is attached at the other end of the oil tube 13. The second housing 12 has a tapered tip 23 with an oil discharge opening 24. A coaxial annular sleeve 9 is attached in the housing 12. A piston 25 is slidable in the sleeve; it defines an oil swirl chamber 26 in the sleeve 9 that may be varied in size. The piston 25 is attached in threaded engagement with the piston tube 21, so that rotation of the knob 15 may vary the effective length of the tangential oil ports 8 in the swirl chamber 26. The oil swirl chamber 26 is connected by two or more approximately tangential openings 8 through the sleeve 9 to the interior of the oil tube 13. The piston 25 has an axial bore that conducts oil under pressure through the piston tube 21 back to the gauge 19 so that the oil pressure may be constantly monitored while rate of oil flow is regulated by varying the obstruction of the tangential openings and the effective size of the chamber 26.

An outer tube 27 is mounted on the oil tube 13 in the following manner:- a nut 28 is rotatably attached to the outer tube 27, by the nut 28 being in threaded engagement with a tubular collar 29 attached to the oil tube 13. By rotating the nut 28, the outer tube 27 can be advanced or retracted with respect to the tip 23 over which it extends. A lock nut 30 secures this adjustment. The nut 28 is captured in the outer tube 27 so that the tube 27 will be moved forward or backward as the nut 28 is rotated.

At the outer end of the outer tube 27, there is a nozzle 31 attached. The nozzle 31 is a tubular body positioned beyond the tip 23; it functions to direct the atomized fuel from the tip 23 in a generally linear path, rather than mushrooming as it emerges from the tip 23. Thus the rotation of the gap adjusting nut 28 governs the distance between the oil discharge opening 24 and the nozzle 31. Once the gap distance between the opening 24 and the nozzle 31 is set, the narrow spray pattern does not change under either high or low flame conditions.

The burner assembly, through its adjustable chamber 26 can regulate the rate of oil flow without change of pressure. The adjustable nozzle 31 can have its position adjusted with respect to high or low oil flow rates so that the oil does not collect on and drip from the nozzle.

The present construction accomplishes atomization of liquid fuel to enhance combustion. The conventional gun produces oil droplets in the order of 100 microns while the present gun produces atomization of oil to approximately 10 microns. The present gun can also utilize steam or another gaseous medium, beside air. Since oil pressure remains constant, under low fire conditions, the air pressure need not be reduced to avoid flameout, but may remain the same whether operation is at low or high flame condition. Atomizing air may be varied in the range of approximately 0.5 to 5 p.s.i., and the plume of the flame will remain narrow, varying from long (at 0.5 p.s.i.) to short (at 5. p.s.i.). The nozzle cone angle of 23° – 30° can be achieved at all conditions of flame adjustment. The tubular portion of the nozzle 31 defines a fuel emission tunnel.

What is claimed is:

1. A burner gun comprising:

a. a oil tube, b. a first housing attached at one end of the oil tube, c. a second housing attached at the other end of the oil tube, d. a piston tube in the oil tube, e. means to move the piston tube axially in the oil tube, f. a swirl chamber in the second housing, g. an oil discharge opening in the end of the swirl chamber communicating with the outside of the second housing and defining an atomizer tip, h. an axially movable piston disposed in the swirl chamber and connected to the piston tube, whereby the piston is moved in the swirl chamber, i. at least one oil passage communicating between the oil tube and the swirl chamber, j. the oil passage incrementally obstructable by the movement of the piston, k. an outer tube surrounding the second housing and mounted coaxially on the oil tube, l. a passage in the outer tube communicating with the interior of the outer tube, for introducing a gas therein, m. means to move the outer tube axially with respect to the oil tube, n. a nozzle on the end of the outer tuber having an elongated emission tunnel axial passage therein, o. the nozzle arranged in spaced relation to the atomizer tip, p. the means to move the outer tube axially with respect to the oil tube adjusts the nozzle with respect to the atomizer tip, q. the piston having an axial bore communicating with the swirl chamber, r. a regulator shaft connected to the piston tube in the first housing, s. an axial bore in the regulator shaft, t. a transverse passage in the regulator shaft, u. an elongated chamber in the first housing in registration with the transverse passage, v. a pressure gauge mounted on the first housing to read the pressure in the elongated chamber.

2. A burner gun according to claim 1 and a plurality of fins mounted on the oil tube in the outer tube to impart a swirling motion to gas coursing through the interior of the outer tube.

3. A burner gun according to claim 1 and the outer tube in threaded engagement with the oil tube.

4. A burner gun according to claim 1 and, a. the swirl chamber generally circular, b. the oil passage entering the chamber approximately tangential thereto at the periphery thereof.

5. A burner gun according to claim 1 in which the means to move the nozzle with respect to the atomizer tip is threaded engagement of the outer tube with the oil tube.

6. A burner gun according to claim 1 in which the means to move the piston tube axially in the outer tube is - a. a regulator shaft connected to the piston tube, b. the regulator shaft in threaded engagement with the first housing, c. a knob on the end of the regulator shaft for turning the shaft.

7. A burner gun according to claim 1 in which the emission tunnel of the nozzle is flared wider adjacent to the atomizer tip.

8. A burner gun comprising:

a. a oil tube, b. a first housing attached at one end of the oil tube, c. a second housing attached at the other end of the oil tube, d. a piston tube in the oil tube, e. a means to move the piston tube axially in the oil tube, f. a swirl chamber in the second housing, adjacent to an oil discharge opening, g. an oil discharge opening at the end of the swirl chamber communicating with the outside of the second housing and defining an atomizer tip, h. an axially movable hollow piston in the swirl chamber connected to the piston tube for fluid communication therewith whereby movement of the hollow piston in the swirl chamber adjusts the volumetric capacity of the swirl chamber.

i. at least one oil passage communication between the oil tube and the swirl chamber, j. the oil passage incrementally obstructable by the movement of the piston, k. an outer tube surrounding the second housing and mounted coaxially on the oil tube, l. a passage in the outer tube communicating with the interior of the outer tube, for introducing a gas therein, m. means to move the outer tube axially with respect to the oil tube, n. a nozzle on the end of the outer tube having an elongated emission tunnel axial passage therein, o. the nozzle arranged in spaced relation to the atomizer tip, p. the means to move the outer tube axially with respect to the oil tube adjusts the nozzle with respect to the atomizer tip.

* * * * *